US009943137B2

(12) United States Patent
Leo

(10) Patent No.: US 9,943,137 B2
(45) **Date of Patent: *Apr. 17, 2018**

(54) SHOE CHARM HOLDER DEVICE

(76) Inventor: Susan Leo, Newfane, NY (US)

( * ) Notice: Subject to any disclaimer, the term of this patent is extended or adjusted under 35 U.S.C. 154(b) by 991 days.

This patent is subject to a terminal disclaimer.

(21) Appl. No.: 13/421,927

(22) Filed: Mar. 16, 2012

(65) Prior Publication Data

US 2012/0174443 A1 Jul. 12, 2012

Related U.S. Application Data

(63) Continuation-in-part of application No. 12/859,916, filed on Aug. 20, 2010, now Pat. No. 8,544,196.

(51) Int. Cl.
*A43B 23/00* (2006.01)
*A43B 23/24* (2006.01)

(52) U.S. Cl.
CPC ..... *A43B 23/24* (2013.01)

(58) Field of Classification Search
CPC ..... A43B 3/30; A43B 21/48; A43B 21/51
USPC ..... 36/112, 34 R, 36 B–36 C, 132, 114, 134
See application file for complete search history.

(56) References Cited

U.S. PATENT DOCUMENTS 979,361 A 12/1910 Vttlpescu et al.
1,414,748 A 5/1922 Palmer
1,484,785 A * 2/1924 Hiss ..... 36/76 R
1,919,095 A 7/1933 De Gennaro
2,096,335 A 10/1937 Nicholas
2,139,885 A 12/1938 De Gironimo
2,174,521 A * 10/1939 Lancaster ..... 24/105
2,552,151 A * 5/1951 Cohen ..... 63/12
2,689,417 A 9/1954 Bernstein et al.
2,723,344 A 11/1955 Greminger Kurt
2,748,517 A * 6/1956 Berkis ..... 40/586
3,141,211 A * 7/1964 Blake ..... 24/114.9
3,354,561 A 11/1967 Cameron
3,357,063 A * 12/1967 Eiben ..... 24/66.6
3,722,565 A 3/1973 Miller et al.
3,893,247 A 7/1975 Dana, III
3,946,505 A 3/1976 Dana, III
4,033,243 A 7/1977 Kirrish et al.
4,050,167 A 9/1977 Senter
4,128,861 A 12/1978 Pelengaris
4,164,971 A 8/1979 Strand
4,202,117 A 5/1980 Bidegain
4,490,083 A 12/1984 Rebish
4,805,320 A 2/1989 Goldenberg et al.
4,887,369 A 12/1989 Bailey et al.
5,079,857 A 1/1992 Clifton
5,243,776 A 9/1993 Zelinko
5,244,326 A 9/1993 Henriksen
(Continued)

*Primary Examiner* — Khoa Huynh
*Assistant Examiner* — Timothy K Trieu
(74) *Attorney, Agent, or Firm* — Hansen IP Law PLLC

(57) ABSTRACT

A charm holder device for attaching charms to a heel breast of a shoe located between the shank and the heel of the shoe. The charm holder device includes an attachment portion attached to the shoe, a shoe engaging portion coupled to the attachment portion and a charm engaging portion with a charm keeper coupled to the shoe engaging portion. The charm keeper receives charms or beads. The attachment portion may be attached to the outsole of the shoe only or be in a bore located on the heel breast of the shoe and extending from the insole to the outsole.

15 Claims, 6 Drawing Sheets

(56) References Cited

U.S. PATENT DOCUMENTS

| | | | | |
|---|---|---|---|---|
| 5,290,131 | A | 3/1994 | Henriksen | |
| 5,371,662 | A | 12/1994 | Shenk-Ko | |
| 5,461,814 | A * | 10/1995 | Reid et al. | 43/1 |
| 5,490,338 | A | 2/1996 | Hwang et al. | |
| 5,549,234 | A | 8/1996 | Hong | |
| 5,655,317 | A | 8/1997 | Grant | |
| 5,673,501 | A * | 10/1997 | Mathews | 36/136 |
| 5,926,980 | A | 7/1999 | Adam | |
| 6,012,763 | A | 1/2000 | Clemente et al. | |
| 6,266,853 | B1 * | 7/2001 | Ho | 24/92 |
| 6,345,472 | B1 | 2/2002 | Taylor | |
| 6,354,231 | B1 | 3/2002 | Morris | |
| 6,434,870 | B1 | 8/2002 | Fanjoy | |
| 6,442,872 | B1 | 9/2002 | Liao | |
| 6,481,122 | B2 | 11/2002 | Brahler | |
| 6,502,332 | B1 | 1/2003 | Nakayama | |
| 6,698,986 | B2 | 3/2004 | Fraleigh | |
| 7,004,699 | B2 | 2/2006 | Petrok et al. | |
| 7,059,070 | B2 | 6/2006 | Omstead et al. | |
| 7,076,894 | B2 | 7/2006 | Santos et al. | |
| 7,578,075 | B1 | 8/2009 | Kemp | |
| 7,661,208 | B2 | 2/2010 | McKinney et al. | |
| 7,695,154 | B2 * | 4/2010 | Ellenburg et al. | 362/103 |
| 7,713,013 | B2 | 5/2010 | Sedgwick et al. | |
| 7,877,902 | B2 | 2/2011 | Pieriboni | |
| 7,937,966 | B2 * | 5/2011 | Golove et al. | 63/40 |
| 7,987,619 | B2 | 8/2011 | McKinney et al. | |
| 7,988,397 | B2 | 8/2011 | Bodin et al. | |
| 8,001,664 | B2 | 8/2011 | Pearce | |
| 8,069,583 | B1 | 12/2011 | Simchuk | |
| 8,210,785 | B1 | 7/2012 | Gager | |
| 2006/0026990 | A1 | 2/2006 | Carter | |
| 2006/0075662 | A1 | 4/2006 | Schupbach | |
| 2006/0180728 | A1 | 8/2006 | Abrantes | |
| 2008/0289076 | A1 | 11/2008 | Millward | |
| 2009/0100869 | A1 * | 4/2009 | Golove et al. | 63/23 |
| 2009/0249654 | A1 | 10/2009 | Baucom et al. | |
| 2010/0239386 | A1 | 9/2010 | Sedgwick et al. | |
| 2010/0289971 | A1 | 11/2010 | Odland et al. | |
| 2010/0307031 | A1 | 12/2010 | Ganito | |
| 2011/0083341 | A1 | 4/2011 | Baum | |
| 2012/0137543 | A1 | 6/2012 | Kemp | |
| 2012/0186105 | A1 | 7/2012 | Kemp et al. | |

* cited by examiner

SHOE CHARM HOLDER DEVICE

REFERENCE TO RELATED APPLICATIONS

This is a continuation-in-part of parent patent application Ser. No. 12/859,916, filed Aug. 20, 2010. The aforementioned application is hereby incorporated herein by reference.

BACKGROUND OF THE INVENTION

Field of the Invention

The invention pertains to the field of shoes. More particularly, the invention pertains to a holder device of charms on shoes.

SUMMARY OF THE INVENTION

A charm holder device located between the shank and the heel of the shoe attaches charms to a heel breast of a shoe. The charm holder device includes an attachment portion attached to the shoe, a shoe engaging portion coupled to the attachment portion and a charm engaging portion with a charm keeper coupled to the shoe engaging portion. The charm keeper receives charms or beads. The attachment portion may be attached to the outsole of the shoe only or be in a bore located on the heel breast of the shoe and extending from the insole to the outsole.

DETAILED DESCRIPTION OF THE INVENTION

Figure 1:
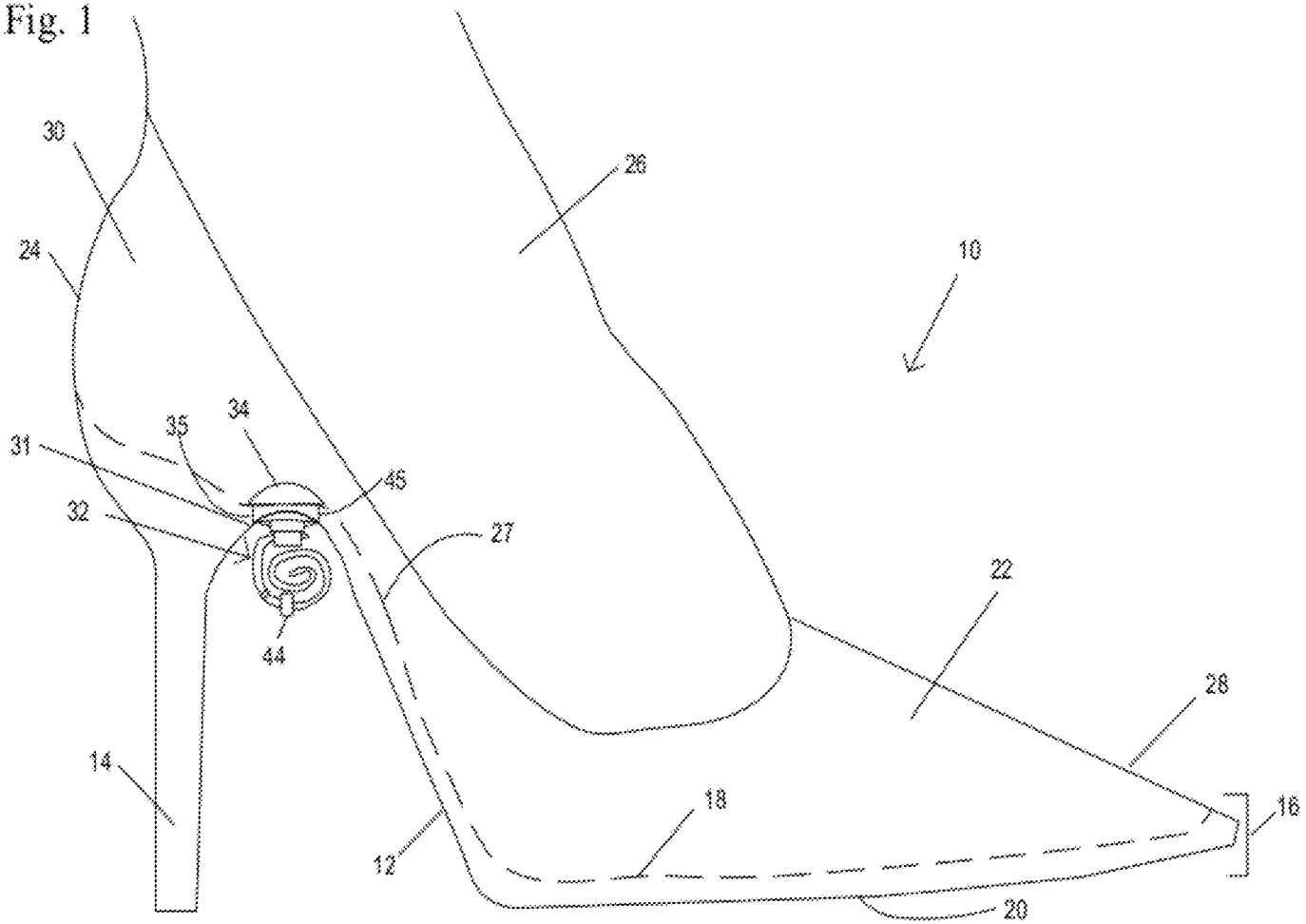
FIG. 1 shows a schematic of a shoe with a shoe charm holder device in an embodiment of the present invention.
Figure 9:
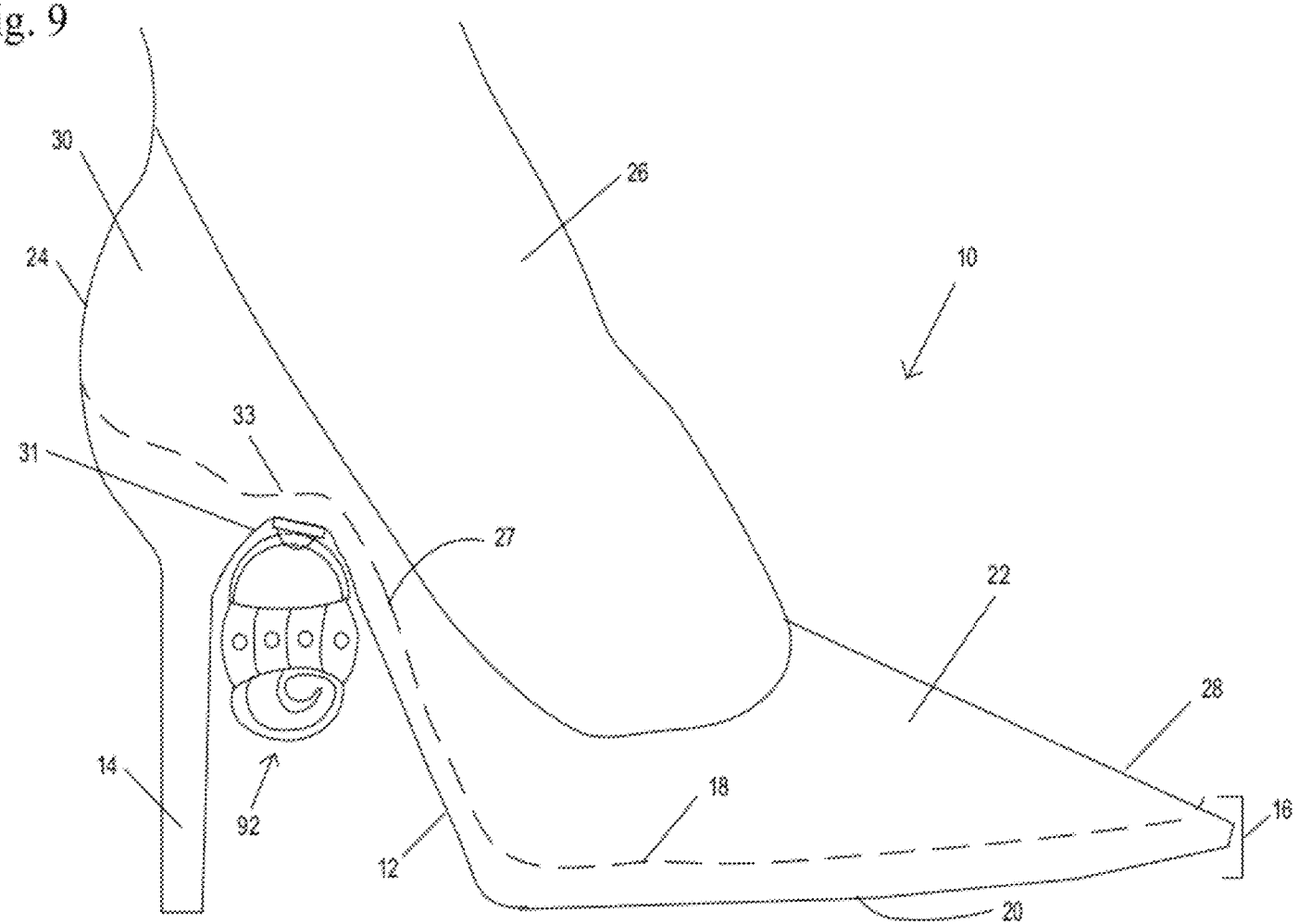
FIG. 9 shows a schematic of a shoe with a shoe charm holder device attached to an outer sole of the shoe of a third embodiment.

As shown in FIGS. 1 and 9, a shoe 10 includes a shank 12 connected to a heel 14, through a heel breast 31 and a sole assembly 16. The shoe 10 also includes an upper covering of the toe region 22 and a counter 24 to support a heel of a wearer's foot 26. The sole assembly 16 includes an insole or inner sole 18 in the interior bottom of the shoe directly beneath the wearer's foot and an outer sole or outsole 20 in contact with the ground. The insole 18 is configured with the foot shape profile of the shoe with a toe end 28, connected to an arch profile 27 corresponding to the natural curvature of the foot's arch through to a heel end 30. The outsole 20 may be made of any suitable outsole material including, but not limited to leather, PVC, polyurethane, TPR, rubber or any combination thereof.

In the first embodiment shown in FIGS. 1 through 5, a bore 35 is present on the heel breast 31 between the shank 12 and the heel 14 of the shoe. The bore 35 extends from the insole 18 through to the outsole 20. The bore 35 receives a portion of a charm holder device 32.

Figure 2:
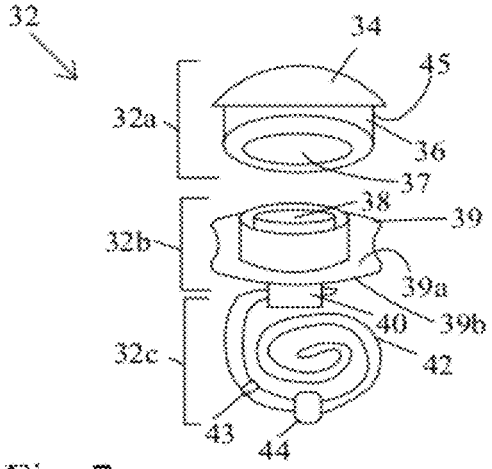
FIG. 2 shows a schematic of a shoe charm holder device of a first embodiment in the present invention.
Figure 3:
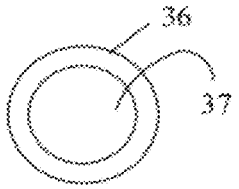
FIG. 3 shows a schematic of a bottom view of the shoe engaging portion of the shoe charm holder device of a first embodiment received by an insole of a shoe.

Referring to FIG. 2, the shoe charm holder device 32 has an attachment portion 32*a* which attaches the shoe charm holder device 32 to the shoe 10; a shoe engaging portion 32*b* which is coupled to the attachment portion 32*a* and couples the charm engaging portion 32*c* to the shoe 10; and a charm engaging portion 32*c* for receiving charms or beads 44.

In the first embodiment, the attachment portion 32*a* of the shoe charm holder device 32 includes a cap head 34 connected to a female socket 36 with outer walls 45 received by a bore 35 on the heel breast 31 of the shoe. The female socket 36 defines an opening 37 for receiving a protruding male snap stud 38 as shown in FIG. 2.

The cap head 34 is preferably mounted perpendicular to outer sides 45 of the female socket 36. The outer sides 45 of the female socket 36 are received within the bore 35. The cap head 34 preferably has a diameter that is larger than the diameter of the bore 35, preventing the cap head 34 from moving from the insole 18 to the outsole 20 through the bore 35. The cap head 34 is preferably shaped such that the cap head 34 is unobtrusive to the wearer's foot. The cap head 34 may be a pan head, a button or dome head, a round head, or a truss head, or any other type of head that is unobtrusive to the wearer's foot.

Figure 4:
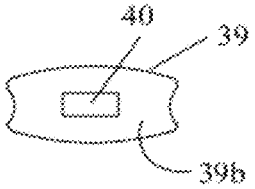
FIG. 4 shows a schematic of a bottom view of the charm engaging portion of the shoe charm holder device of a first embodiment received by the shoe engaging portion of the shoe charm holder.

The shoe engaging portion 32*b* includes a base 39 with a first side 39*a* including a protruding male snap stud 38 and a second side 39*b* with a nipple 40 for coupling to a charm keeper 42 of the charm engaging portion 32*c* as shown in FIG. 4. The shoe engaging portion 32*b* attaches to the attachment portion by snapping the protruding male snap stud 38 into the female socket 36.

The charm keeper 42 may be fixedly attached to the nipple 40 or removably attached to the nipple 40 through a clasp (not shown). The charm keeper 42 has a hinge 43 which allows the charm keeper 42 to be moved from a first position in which charms or beads 44 may be added or removed from the charm keeper 42 to a second position in which charms or beads 44 are prevented from being removed or dislodged from the charm keeper 42.

Figure 5:
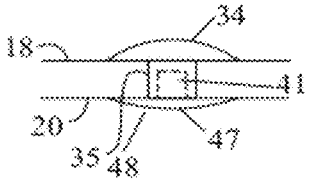
FIG. 5 shows a cap received by the attachment portion of the shoe charm holder device of a first embodiment when a wearer does not want to attach the charm engaging portion of the shoe charm holder device.

Referring to FIG. 5, when a wearer does not wish to have the charm engaging portion 32*c* present on the heel breast 31 of the shoe, a separate male cap stud 48 with a head 47 is received by the female socket 36 of the attachment portion 32*a*, such that when the protruding male snap stud 41 of the separate male cap stud 48 snaps into the female socket 36, with the head 47 resting against the outer sole 20 of the shoe 10, the shoe charm holder device 32 appears flat or nearly flush with the outer sole 20 of the underside of the shoe 10.

Figure 7:
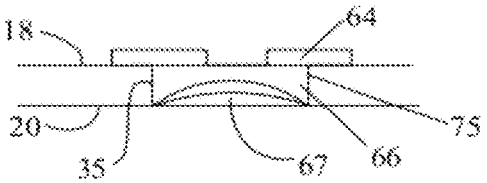
FIG. 7 shows a schematic of a cap of the shoe charm holder device received by an insole of a shoe of a second embodiment.
Figure 6:
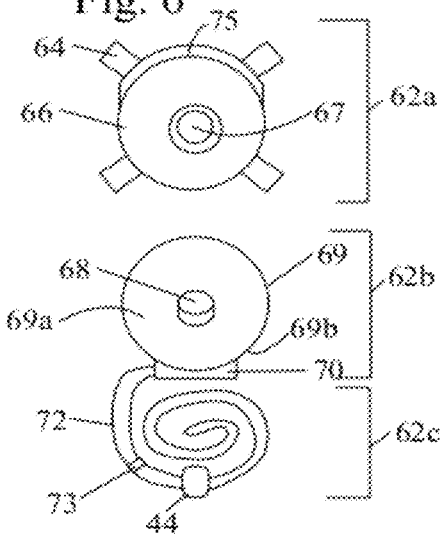
FIG. 6 shows a schematic of the attachment portion, shoe engaging portion, and the charm engaging portion of the shoe charm holder device of a second embodiment.
Figure 8:
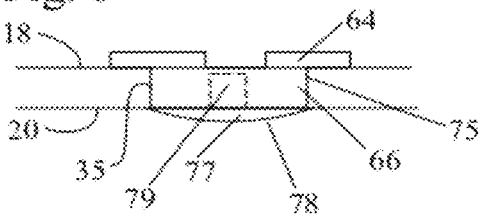
FIG. 8 shows a cap received by the attachment portion of the shoe charm holder device of a second embodiment when a wearer does not want to attach the charm engaging portion of the shoe charm holder device.

FIGS. 6-8 show an alternate charm holder device of a second embodiment received within a bore 35 on the heel breast 31 of the shoe 10 between the shank 12 and heel 14 of the shoe 10 that extends from the insole 18 through to the outsole 20.

In this embodiment, the shoe charm holder device 62 has an attachment portion 62*a* which attaches the shoe charm holder device 62 to the shoe 10; a shoe engaging portion 62*b* which is coupled to the attachment portion 62*a* and couples the charm engaging portion 62*c* to the shoe 10; and a charm engaging portion 62*c* for receiving charms or beads 44.

The attachment portion 62*a* of the shoe charm holder device 62 includes laterally extending tabs 64 that extend outwards from outer walls 75 of a female magnetic socket 66 received by the bore 35 and rest on or engage the insole 18 of the shoe 10. The tabs 64 prevent the female magnetic socket 66 from moving from the insole 18 to the outsole 20 through the bore 35. The tabs 64 lay flat on the insole 18 and are not obtrusive to the wearer's foot. The female socket 66 defines an opening 67 for receiving a protruding male snap stud 68 as shown in FIG. 6.

The shoe engaging portion 62*b* includes a base 69 with a first side 69*a* including a protruding male magnetic snap stud 68 and a second side 69*b* with a nipple 70 for coupling to a charm keeper 62 of the charm engaging portion 62*c*. The shoe engaging portion 62*b* attaches to the attachment portion 62*a* by magnetically snapping the protruding male snap stud 68 into the female socket 66.

The charm keeper 62 may be fixedly attached to the nipple 70 or removably attached to the nipple 70 through a clasp (not shown). The charm keeper 72 has a hinge 73 which allows the charm keeper 72 to be moved from a first position in which charms or beads 74 may be added or removed from the charm keeper 72 to a second position in which charms or beads 44 are prevented from being removed or dislodged from the charm keeper 72.

Referring to FIG. 8, when a wearer does not wish to have the charm engaging portion 62*c* present on the heel breast 31 of the shoe, a separate male cap stud 78 with a head 77 and a protruding male snap stud 79 is received by the female socket 66 of the attachment portion 62*a*, such that when the separate male cap stud 78 snaps into the female socket 66, with the head 77 resting against the outer sole 20 of the shoe 10, the shoe charm holder device 62 appears flat or nearly flush with the outer sole 20 of the underside of the shoe 10.

FIG. 9 shows a charm holder device 92 of a third embodiment. The shoe charm holder device 92 has an attachment portion 92*a* which attaches the shoe charm holder device 92 to the shoe 10; a shoe engaging portion 92*b* which is coupled to the attachment portion 92*a* and couples the charm engaging portion 92*c* to the shoe 10; and a charm engaging portion 92*c* for receiving charms or beads 44.

The attachment portion 92*a* is an attachment strip 102 that is directly attached to the outer sole 20 of the shoe. The attachment strip 102 may be fixedly attached to the outer sole 20 of the shoe 10 using an adhesive. Alternatively, the attachment strip 102 may be removably attached using a hook and loop fastener material, such as 3M® Dual Loop® Fastener or through magnets, where another magnet is placed underneath the insole 18 of the shoe 10 and the attachment strip 102 on the outer sole 20 of the shoe is magnetically attracted to the magnet underneath the insole 18 of the shoe. It should be noted that the adhesive, hook and loop fastener or the magnets need to be of sufficient strength to manage the weight of the shoe engaging portion 92*b* and the charm engaging portion 92*c* including any charms 44 and maintain the attachment of the shoe engaging portion 92*b* and the charm engaging portion 92*c* to the shoe 10.

Figure 14A:
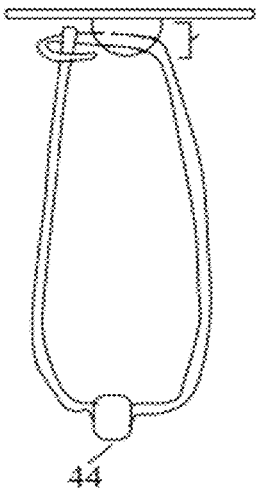
FIG. 14 shows another example of a shoe charm holder device design for attachment to the heel breast of a shoe.
Figure 14B:
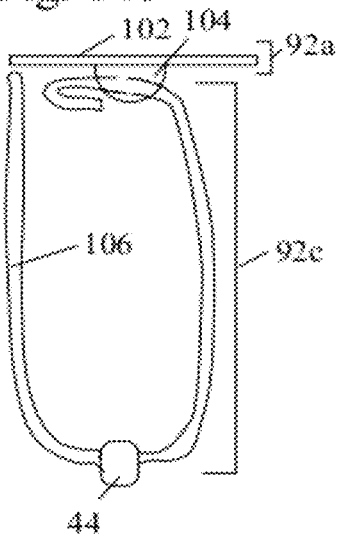

The shoe engaging portion 92*b* includes a nipple 104 for receiving a looped portion 108 for coupling to a charm keeper 106 of the charm engaging portion 92*c* for example as shown in FIGS. 14*a*-14*b*.

Figure 10:
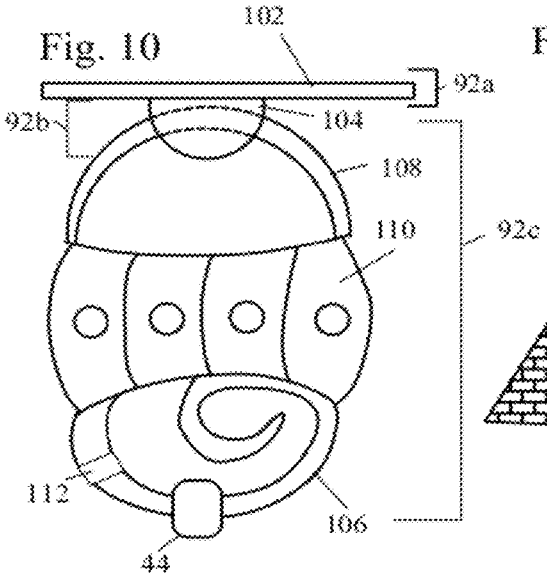
FIG. 10 shows an example of a shoe charm holder device design for attachment to the heel breast of a shoe.
Figure 11:
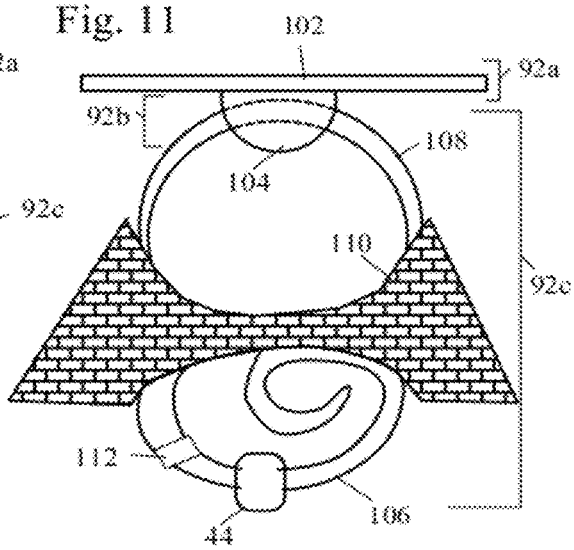
FIG. 11 shows another example of a shoe charm holder device design for attachment to the heel breast of a shoe.

The looped portion 108 may be coupled to the charm keeper 106 through a body 110 as shown in FIGS. 10 and 11. The body 110 may be of various shapes such as irregular polygons and skulls. The looped portion 108 may include a clasp that allows the looped portion to be removed from the nipple 104. The shoe engaging portion 92*b* is preferably fixedly attached to the attachment portion 92*a* through an adhesive or may be removably attached by magnets.

Figure 13:
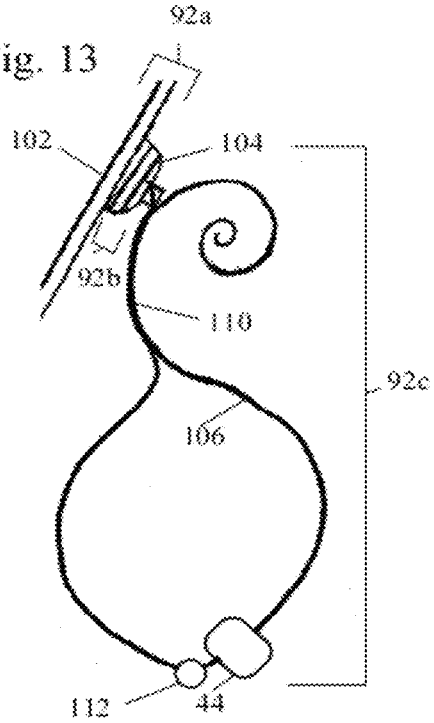
FIG. 13 shows another example of a shoe charm holder device design for attachment to the heel breast of a shoe.
Figure 15:
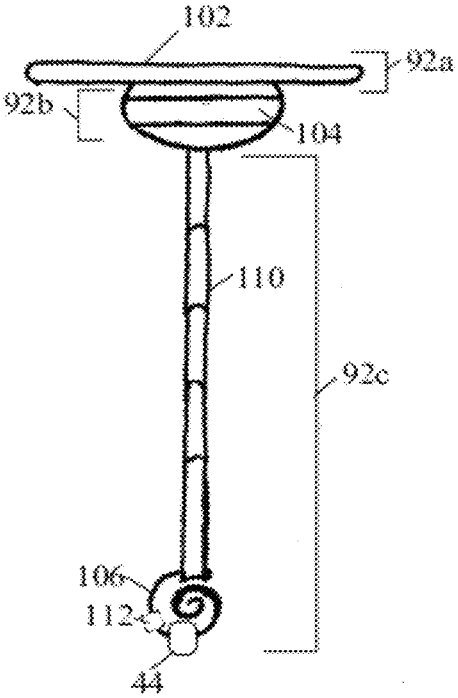
FIG. 15 shows another example of a shoe charm holder device design for attachment to the heel breast of a shoe.

Alternatively, shoe engaging portion 92*b* includes a nipple 104 which is directly attached to the body 110 of the charm engaging portion, for example as shown in FIGS. 13 and 15.

Figure 12:
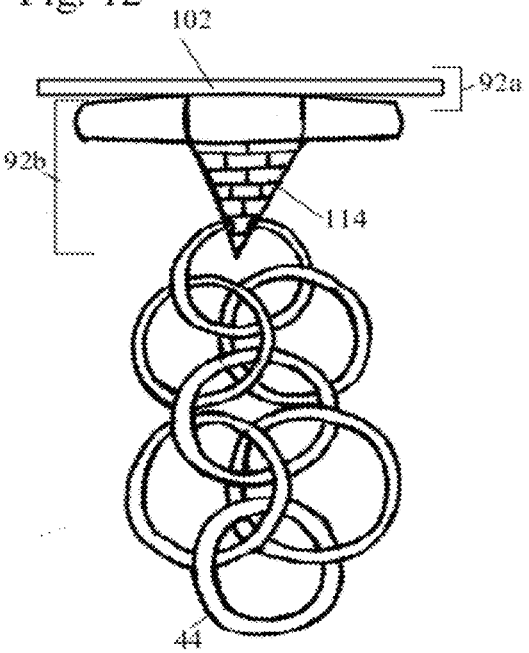
FIG. 12 shows another example of a shoe charm holder device design for attachment to the heel breast of a shoe.

In another embodiment, the shoe engaging portion 92*b* can include a triangular protrusion 114 which can be directly coupled to a charm 44, for example interconnected rings as shown in FIG. 12.

Figure 16:
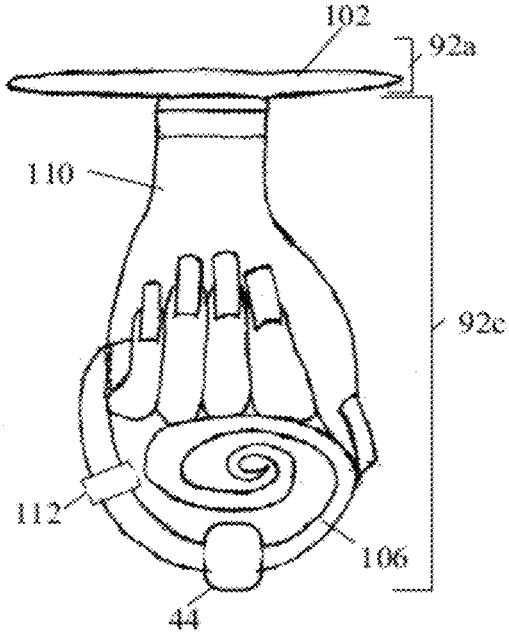
FIG. 16 shows another example of a shoe charm holder device design for attachment to the heel breast of a shoe.
Figure 17:
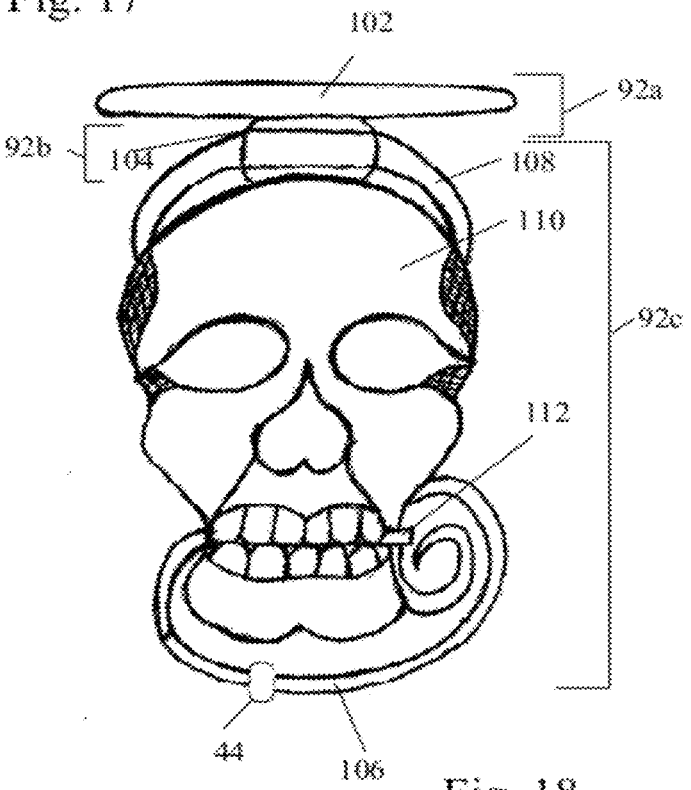
FIG. 17 shows another example of a shoe charm holder device design for attachment to the heel breast of a shoe.

In another embodiment, the body 110 of the charm engaging portion 92*c* can be directly connected to the attachment portion 92*a*, eliminating the shoe engaging portion 92*b*. The body may be hand shaped, oval shaped, or tear drop shaped for example as shown in FIGS. 16, 18, and 14 respectively.

The charm keeper 106 preferably has a hinge 112 which allows the charm keeper 106 to be moved from a first position in which charms or beads 44 may be added or removed from the charm keeper 106 to a second position in which charms or beads 44 are prevented from being removed or dislodged from the charm keeper 106.

Figure 18:
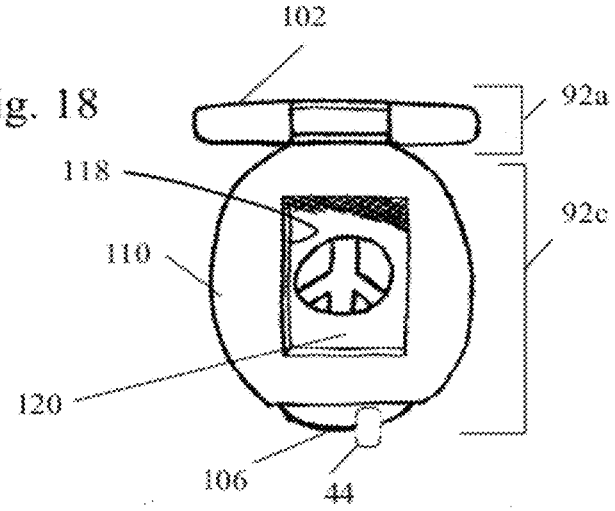
FIG. 18 shows another example of a shoe charm holder device design for attachment to the heel breast of a shoe.

Additionally, the body of the shoe charm holder device in any of the embodiments may have a cutout 118 for receiving decorative plates 120 as shown in FIG. 18.

The charms may be made of plastic, gold, silver, bronze, glass, nickel, or any other alloy.

It should be noted that the charms maybe of different lengths depending on the heel height of the shoe.

Furthermore, the charm or ornament 44 may be of any design that can be removeably attached to the charm keeper and is not limited to any of the designs shown in the drawings.

While the shoes in FIGS. 1 and 9 are shown with an upper covering 22 of the toe region of a wearer's foot and a counter 24 to support the heel of a wearer, the shoe may alternatively just have straps on the toe region and/or around the heel.

The shoe 10 in which the shoe charm holder device is installed preferably has a heel that is at least 0.5 inches above the ground or greater and preferably includes, but is not limited to, kitten heels, high heels, and stilettos.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A charm holder device comprising:

an attachment portion having a female socket;

a base having a first side including a male protrusion for snapping into the female socket and a second side coupled to a nipple;

a charm engaging portion coupled to the nipple of the base comprising a charm keeper for receiving charms;

wherein the charm keeper is moveable from a first open position in which charms may be received to a second closed position in which charms are detained on the charm keeper.

2. The device of claim 1, wherein the female socket and the male protrusion are magnetic.

3. The device of claim 1, wherein the charm keeper is movable between a first open position to a second closed position through a hinge.

4. A charm holder device comprising: an attachment portion comprising an attachment strip; a shoe engaging portion coupled to the attachment portion; and a charm engaging portion mounted to the shoe engaging portion comprising a charm keeper for receiving charms, wherein the charm keeper is moveable from a first open position in which charms may be received to a second closed position in which charms are detained on the charm keeper, wherein the charm keeper is movable between a first open position to a second closed position through a hinge.

5. A shoe, comprising: an insole; an outer sole; a heel breast, a bore extending from the insole to the outersole at the heel breast, and a charm holder device comprising: an attachment portion having a female socket; a base having a first side including a male protrusion for snapping into the female socket and a second side coupled to a nipple; a charm engaging portion coupled to the nipple of the base comprising a charm keeper for receiving charms;

wherein the charm keeper is moveable from a first open position in which charms may be received to a second closed position in which charms are detained on the charm keeper;

wherein the attachment portion is received within the bore and the male protrusion of the base is snapped into the female socket.

6. The shoe of claim 5, wherein the attachment portion further comprises a cap head mounted to the female socket having a diameter larger than a diameter of the bore.

7. The shoe of claim 5, wherein the attachment portion comprises outwardly extending tabs mounted to the female socket engaging the insole of the shoe.

8. The shoe of claim 5, further comprising a shank and a heel, wherein the heel breast is located between the shank and the heel.

9. A shoe, comprising: an insole; an outer sole; a heel breast; and a charm holder device comprising: an attachment portion comprising an attachment strip; a shoe engaging portion coupled to the attachment portion; and a charm engaging portion mounted to the shoe engaging portion comprising a charm keeper for receiving charms, wherein the charm keeper is moveable from a first open position in which charms may be received to a second closed position in which charms are detained on the charm keeper;

wherein the attachment strip of the attachment portion is attached directly to the outer sole at the heel breast.

10. The shoe of claim 9, wherein the attachment portion further comprises a magnetic strip located between the insole and the outer sole.

11. The shoe of claim 10, wherein the attachment strip is magnetic and attached to the magnetic strip between the insole and the outer sole of the shoe.

12. The shoe of claim 9, further comprising a shank and a heel, wherein the heel breast is located between the shank and the heel.

13. The shoe of claim 12, wherein the attachment strip of the attachment portion is attached directly to the outer sole using adhesive.

14. The shoe of claim 12, wherein the shoe engaging portion is attached directly to the outer sole using a hook and loop fastener.

15. A shoe, comprising: an outer sole; a shank; a heel; a heel breast between the shank and the heel; and a charm holder device comprising: an attachment portion comprising an attachment strip; and a charm engaging portion mounted to the attachment portion comprising a charm keeper for receiving charms, wherein the charm keeper is moveable from a first open position in which charms may be received to a second closed position in which charms are detained on the charm keeper; wherein the attachment portion is attached directly to the outer sole at the heel breast.

* * * * *